United States Patent [19]

Toma

[11] 4,325,234

[45] Apr. 20, 1982

[54] ADJUSTABLE STOKE AGITATION SYSTEM

[75] Inventor: Daniel N. Toma, Georgetown, Ind.

[73] Assignee: General Electric Company, Louisville, Ky.

[21] Appl. No.: 196,908

[22] Filed: Oct. 14, 1980

[51] Int. Cl.[3] ..... D06F 13/02

[52] U.S. Cl. ..... 68/133

[58] Field of Search ..... 68/133, 134

[56] References Cited

U.S. PATENT DOCUMENTS

| | | | |
|---|---|---|---|
| 2,821,840 | 2/1958 | Hays | 68/133 X |
| 2,869,699 | 1/1959 | Bochan | 68/23.7 X |
| 3,095,721 | 7/1963 | Bochan | 68/133 |
| 3,213,651 | 10/1965 | Worst | 68/133 |
| 3,600,902 | 8/1971 | Williams | 68/134 |
| 3,805,559 | 4/1974 | Waugh et al. | 68/134 X |
| 4,170,882 | 10/1979 | Brenner et al. | 68/133 |

*Primary Examiner*—Philip H. Coe

*Attorney, Agent, or Firm*—Radford M. Reams

[57] ABSTRACT

An adjustable agitation system for an automatic washing machine, a drive shaft oscillatable about a first axis and an agitator oscillatable about a second axis. First and second drive members are mounted for oscillation with the drive shaft and agitator and form a plurality of selectively engageable finger and slot arrangements for oscillating the agitator through a selected one of a plurality of arcs in response to oscillation of the drive shaft through a predetermined arc.

7 Claims, 6 Drawing Figures

ADJUSTABLE STOKE AGITATION SYSTEM

BACKGROUND OF THE INVENTION

The present invention relates to automatic clothes washers of the vertical axis type and, more particularly, to an adjustable agitation system for use in such washers.

In automatic clothes washing machines it is desirable to provide for selectively varying the energy input of the agitator to the wash fluid and the clothes contained in the fluid. Generally, in the past this has been done by changing the speed of the input to the transmission and agitator. For example, in some commercially available washing machines from General Electric Company, assignee of the present invention, a multi-speed clutch is connected between a single speed motor and the transmission of the washing machine. By selectively energizing the clutch, the input speed of the transmission and thus the oscillation speed of the agitator is selectively varied. In other commercially available washing machines, variation in the speed of the agitator is obtained by utilizing a multi-speed drive motor. Both such approaches are relatively expensive and require complicated control circuitry for selecting the desired input speed. Other commercially available washing machines have multiple agitators. Generally a "regular" agitator is nested over a "gentle" agitator. Normally the "regular" agitator effects the washing. When the "regular" agitator is removed from the machine, washing is effected by the "gentle" agitator. Since the "gentle" agitator is smaller, less energy is imparted to the fabrics being washed.

It is therefore an object of the present invention to provide a new and improved agitation system for a clothes washing machine.

It is another object of this invention to provide such a system wherein the energy input is varied by selectively varying the length of the arc through which the agitator oscillates.

SUMMARY OF THE INVENTION

In accordance with one form of the present invention, there is provided an adjustable agitation system including an elongated input shaft oscillatable about a first, generally vertical axis and an agitator mounted for oscillation about a second generally vertical axis, spaced from the first axis. A first drive member is mounted for oscillation with the input shaft and a second drive member is mounted for oscillation with the agitator. The first and second drive members are constructed and arranged to form a plurality of selectively engageable finger and slot arrangements extending radially of the first axis of rotation for oscillating the agitator through a selected one of plurality of arcs in response to oscillation of the input shaft through a predetermined arc, while allowing relative radial movement of the engaged finger and slot arrangement.

The energy input to a load of fabrics in an agitator washing machine varies with a number of factors, one of which is a power of the length of the arc of the stroke of the agitator. Thus, a relatively small change in the arc length of the oscillation stroke of the agitator will make a fairly significant change in the energy input to the load of fabrics.

DESCRIPTION OF PREFERRED EMBODIMENT

Figure 1:
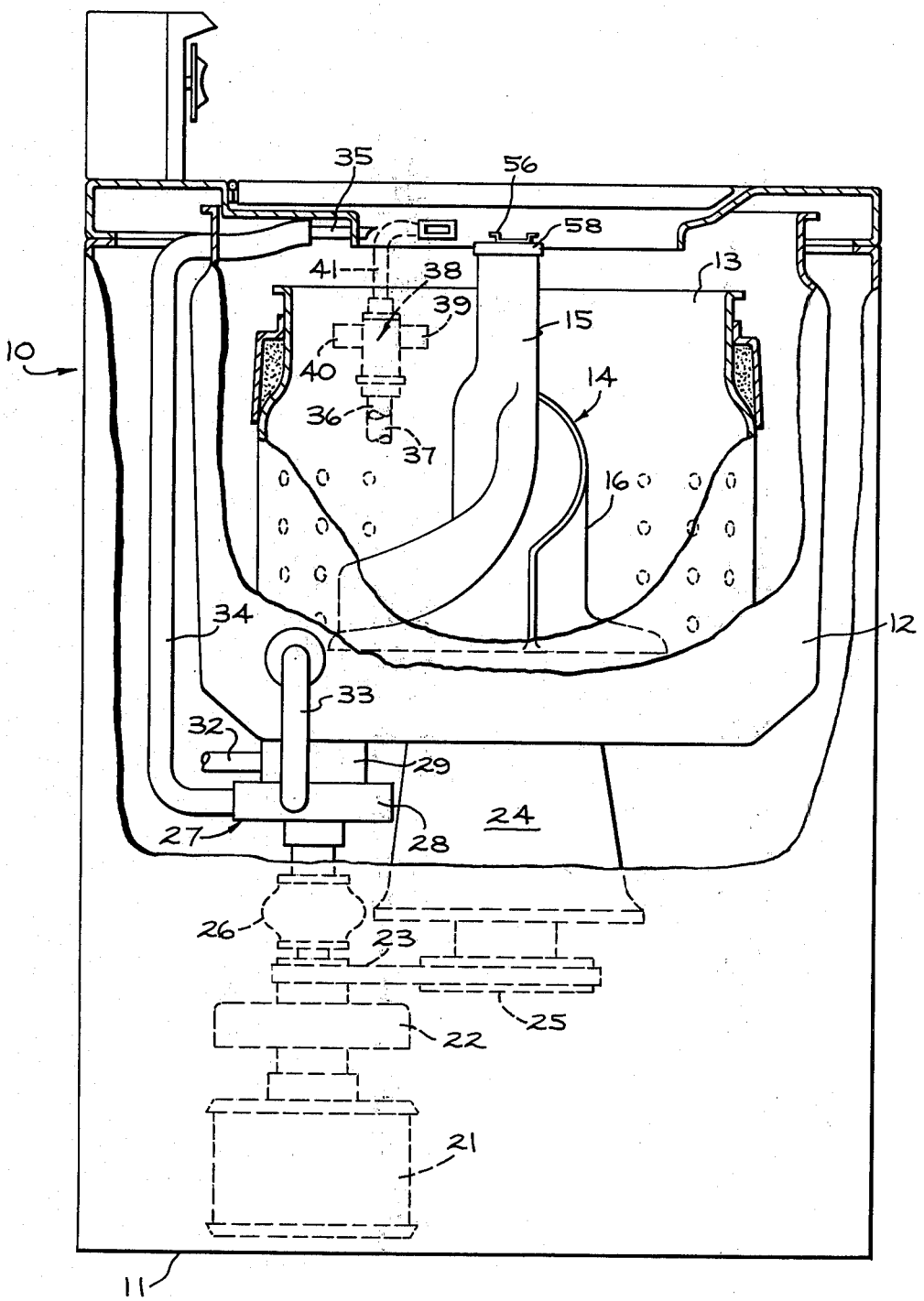
FIG. 1 is a schematic front elevational view of a clothes washing machine incorporating one embodiment of the present invention, the view being partly broken away and partly in section.

Referring now to the drawings, and initially more particularly to FIG. 1, there is illustrated an agitator type vertical axis automatic clothes washer 10 having a supporting structure or cabinet 11. The washer may include various operational components conventionally utilized in domestic washing machines. For instance, an imperforate tub 12 is rigidly mounted within the cabinet 11 and a perforate washing basket 13 is rotatably supported within tub 12 for washing and rinsing clothes and for centrifugally extracting liquid therefrom. At the center of the basket 13 there is provided an agitator 14 which includes a center post 15 and a plurality of water and fabric circulating veins 16.

Both the clothes basket 13 and the agitator 14 are rotatably mounted. During one typical cycle of operation of the washer 10, fabrics, detergent and a predetermined quantity of water are introduced into the tub 12 and basket 13, the agitator is then oscillated back and forth about its axis to move the clothes within the basket. After a predetermined period of this washing action, the agitator and basket are rotated in unison at high speed to centrifugally extract the washing liquid from the fabrics and discharge it to a drain (not shown). Following this extraction operation, a supply of clean water is introduced into the basket and tub for rinsing the fabrics and the agitator is again oscillated. Finally the agitator and basket are once more rotated in unison at high speed to extract the rinse water.

The basket 13 and agitator 14 may be driven by any suitable means. By way of example I have shown them to be driven by a single speed, reversible motor 21 through a drive mechanism including a single speed clutch 22 mounted on the output shaft of the motor. The motor is tailored so as to be used to its full extent when it accelerates the basket 13 to spin speed. In order to assist the motor during the beginning of centrifugal extraction operation, the clutch 22 slips to allow the motor to start with less than a full load and then to accept the full load as it comes up to speed. In the agitation direction of rotation of the motor the clutch does not slip so that the motor accepts full load for agitation immediately. A suitable belt 23 transmits power from clutch 22 to a transmission assembly 24 through a pulley 25. Thus, depending on the direction of motor rotation, the pulley 25 of transmission 24 is driven in opposite directions. The transmission is arranged so that it supports and drives both input drive shaft 20 (see FIG. 2) and a hub (not shown) to which basket 13 is mounted for rotation. When motor 21 is rotated in first direction, transmission 24 causes agitator 14 to oscillate and when motor 21 is driven in the opposite direction, transmission 24 causes basket 13 and agitator 14 to rotate together at high speed for centrifugal fluid extraction.

In addition to operating the transmission 24, as described, motor 21 also provides a direct drive through a flexible coupling 26 to a pump structure 27, which includes two separate pumping units 28 and 29 which are operated simultaneously in the same direction by motor 21. Pump unit 29 has an inlet connected to the tub 12 and an outlet connected by a conduit 32 to a suitable external drain (not shown). Pump 28 has an inlet connected by a conduit 33 to the interior of tub 12 and an outlet connected by a conduit 34 to a nozzle 35 which is positioned to discharge into the basket 13. Conventionally, nozzle 35 is discharged into a suitable filter (not shown) which in turn discharges into the basket 13. With this structure, when motor 21 is operating so as to provide for the washing or agitation mode, pump unit 28 withdraws liquid from tub 12 and discharges it through conduit 34 and a suitable filter into the basket. Conversely, when the motor is reversed so as to rotate the basket 13 and agitator 14 together at high speed to centrifugally extract liquid from the fabrics in the basket, pump unit 29 will draw liquid from the tub and discharge it through conduit 32 to drain. Each of the pumps is constructed to be substantially inoperative in the direction of rotation in which it is not used.

Hot and cold water may be supplied to the machine through conduits 36 and 37 which are adapted to be connected respectively to sources hot and cold water (not shown). Conduits 36 and 37 extend into a conventional mixing valve structure 38 having solenoids 39 and 40 and being connected to a hose 41. In a conventional manner selective or concurrent energization of solenoids 39 and 40 will provide for the passage of hot, cold or warm water from the mixing valve 38 through the hose 41. Hose 41 is positioned to discharge into the basket 13 so that when one or both of solenoids 39 and 40 are energized, water enters basket 13 and tub 12.

In operation, the tub 12 and basket 13 are filled to a desired level with washing liquid. Shaft 20 is oscillated and causes the agitator and its vanes 16 to oscillate and produce a desired washing operation within the basket 13. The level of washing action can be varied by varying any of a number of factors including the speed of oscillation of the agitator, the size of the agitator or the length of the arc of oscillation of the agitator. In accordance with the present invention, the washing action of the agitator is selectively adjusted by adjusting the length of the arc the agitator oscillates through in response to a predetermined length of arc of oscillation of the shaft 20.

Figure 2:
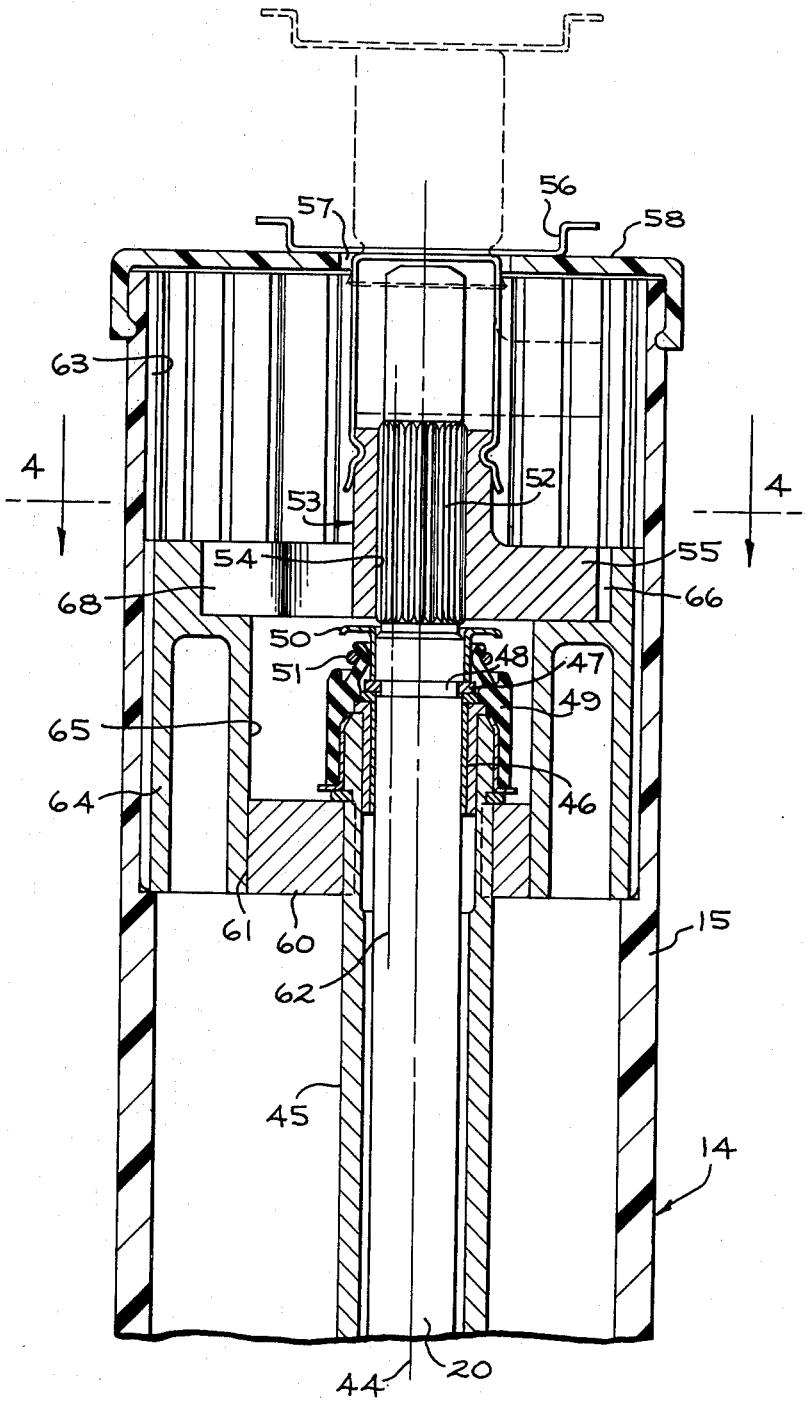
FIG. 2 is a fragmentary elevational view of the agitator center post and the drive arrangement utilized in the washing machine of FIG. 1, the view being in cross section.

Referring more particularly now to FIGS. 2–6 the illustrative adjustable agitation system will be described. The agitator input drive shaft 20 extends upwardly within the center post 15 of the agitator 14 and is mounted for oscillation about an elongated, generally vertical axis 44. The shaft 20 extends upwardly through a stationary support tube 45 and is rotatably supported within the upper end of the tube 45 by a bearing arrangement generally indicated at 46 which, in part, defines axis 44. The shaft is retained against longitudinal movement downwardly, as seen in FIG. 2, by means of a split ring retainer 47 which is received within a recess 48 in the shaft 20. The upper end of the tube 45 is sealed against the entry of liquid by an arrangement including a running seal 49 which is mounted about the outside of the tube 45 and a bearing collar 50 which is mounted to the outside of the shaft 20. An O-ring 51 maintains the running seal 49 against the collar 50.

The outer surface of the shaft 20, above the seal 49, is formed with a plurality of longitudinal or vertically extending splines 52. A first drive member 53 includes a serrated or splined bore 54 which interfits with the splines 52 of the shaft 20 so that the drive member 53 oscillates with the shaft as the shaft 20 oscillates. The drive member 53 also includes an elongated finger 55 which projects outwardly in a direction generally radially of the axis 44. A handle 56 is snap-fit to the drive member 53. The handle extends through an opening 57 at the top of the agitator center post 15. A user of the washing machine may grasp the handle 56 and pull it upwardly so that the drive member 53 is raised until splined bore 54 moves axially above the splines 52 and then rotate the handle to vary the angular positioning of the finger 55 relative to the shaft 20 and agitator center post 15. When the handle 56 is pushed downwardly, the splined bore 54 re-engages with the splines 52 of the shaft 20 to again lock the drive member 53 to shaft 20 for oscillation therewith. The number or configuration of the splines or other teeth on the shaft 20 and drive member 53 is not critical. What is necessary is that the connection between shaft 20 and member 53 oscillates member 53 with shaft 20 while allowing selective angular adjustment between them.

Figure 6:
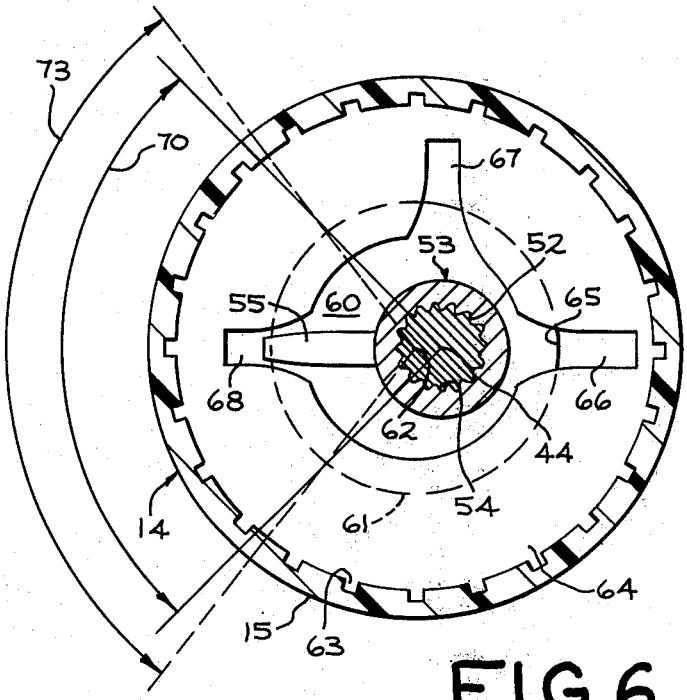
FIG. 6 is a sectional view similar to FIG. 4 but showing the drive arrangement in a third of its selectable configurations.
Figure 4:
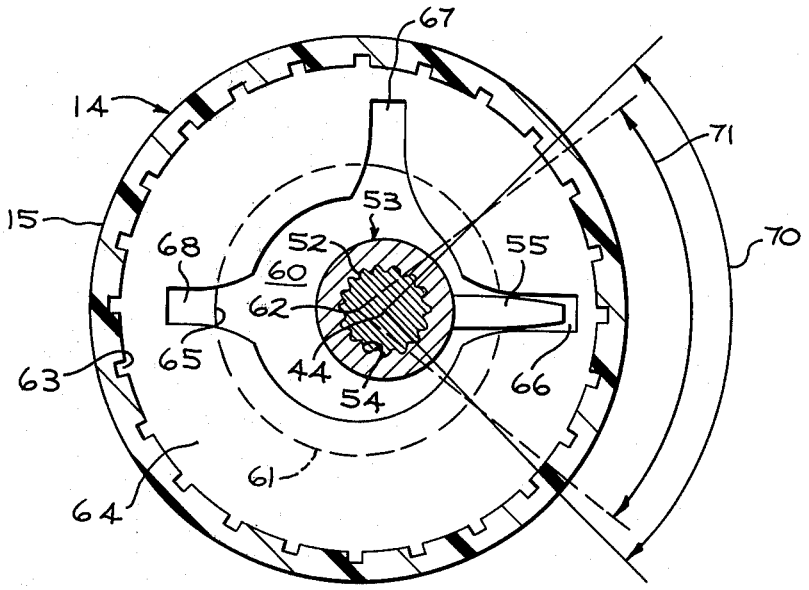
FIG. 4 is a cross sectional view taken along lines 4—4 in FIG. 2, and showing the drive arrangement in a first of its selectable configurations.
Figure 5:
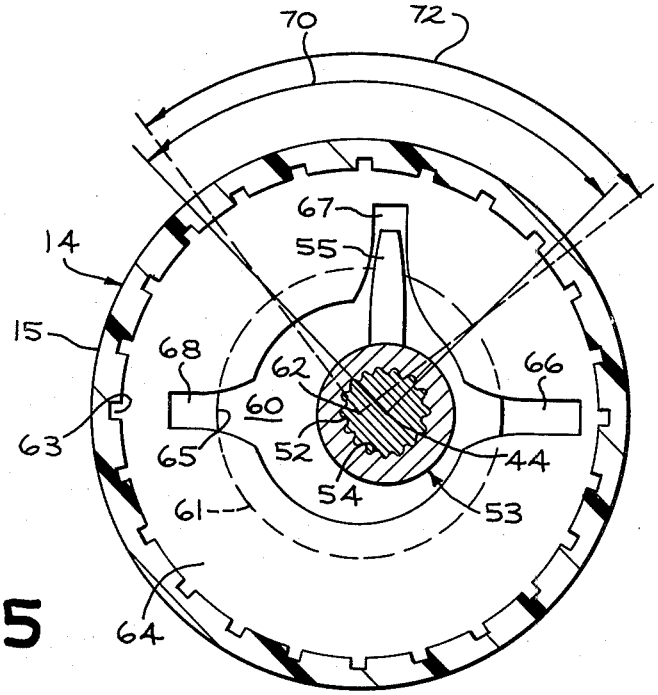
FIG. 5 is a cross sectional view similar to FIG. 4 but illustrating the drive arrangement in a second of its selectable configurations.

A bearing 60 is mounted about the stationary tube 45 and includes a circumferential outer bearing surface 61. The axis 62 of the circumferential surface 61 is generally vertical and is offset from the vertical axis 44 of shaft 20. The inner surface of center post 15 is formed with splines or teeth as indicated at 63 so as to mount a second drive member or spider 64 for rotational movement with the center post 15. The drive member 64 includes an internal bore 65 formed axially of the agitator center post 15 and slidably received on bearing surface 61. Thus the vertical axis 62 of bearing 60 is also the vertical axis about which the agitator 14 oscillates during washing and about which it rotates during centrifugal extraction. The upper portion of the bore 65 is formed with three elongated slots or recesses 66, 67 and 68, respectively. As seen in FIGS. 4–6, each of the slots is formed to extend radially of the axis 44 when the agitator 14 is mounted over the shaft 20. However, the spacing and positioning of each slot relative to the axis 62 of the agitator 14 is different from each of the other slots. The elongated finger 55 of drive member 53 is adapted to be received in a selected one of the slots 66, 67, 68 in order to drivingly connect the input shaft 20 to the agitator 14.

Engagement of the finger 55 in the selected slot transfers oscillatory motion of the shaft 20 to the agitator 14 and causes the agitator to oscillate. At the same time, the sliding fit between the finger 55 and the selected one of slots 66, 67 and 68 allows relative motion longitudinally of the finger and slot, that is generally radially with respect to axis 44. This accommodates relative movement between the shaft 20 and agitator 14 resulting from the fact that the shaft rotates or oscillates about axis 44 while the agitator oscillates about offset axis 62. Receipt of the finger 55 in a selected one of the slots 66–68 will result in the agitator being oscillated through an arc of a different length than receipt of the finger 55 and either of the other of the slots. In each of FIGS. 4, 5 and 6 the drive shaft 20 oscillates through the same predetermined arc 70. As shown in FIG. 4, engagement of finger 55 in slot 66 results in the agitator 14 oscillating through an arc 71 which is smaller than the arc 70. As shown in FIG. 5, engagement of finger 55 in slot 67 results in the agitator 14 oscillating through arc 72 which is the same length as arc 70 but slightly displaced with respect to arc 70. As seen in FIG. 6, receipt of finger 55 in slot 68 results in agitator 14 oscillating through an arc 73 which is larger than arc 70. Since the energy input to the liquid in fabric load is a function, among other things, of a power of the length of the arc, these three different arc lengths result in three significantly different power inputs to the load. By way of example, I modified a commercially available washing machine from General Electric Company by adding a three position variable arc mechanism with an eccentricity of 0.2 inch between its pivot points. I obtained agitator arcs of 185°, 160° and 135°. The power input to an eight pound AHAM standard fabric load was approximately 550 watts, 510 watts and 450 watts respectively.

Figure 3:
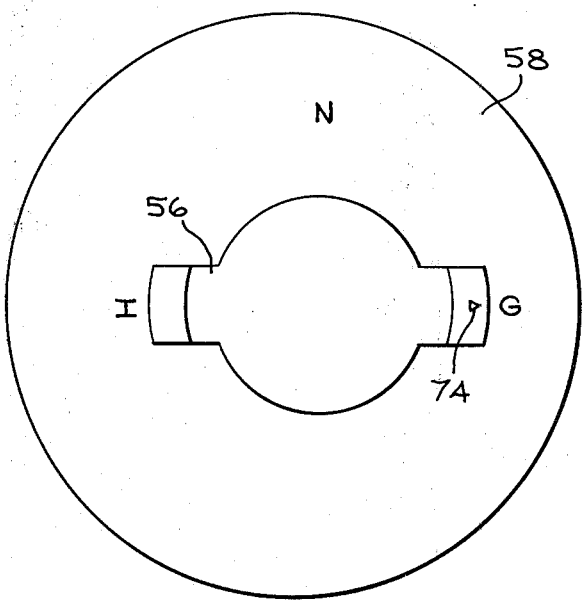
FIG. 3 has a top plan view of the agitator center post of the machine of FIG. 1.

In order to move the finger 55 between selected ones of the slots, the handle 56 is grasped and pulled up to raise member 53 and disengage the splined bore 54 from the splines 52, the handle is rotated to bring the finger 55 into alignment with the selected slot and the handle then is pushed downwardly or inwardly of the agitator to engage the finger 55 in the newly selected slot and to re-engage the splined bore 54 with the splines 52. FIG. 3 illustrates the top 58 of the agitator and the handle 56. It will be noted that the handle includes an indicia 74 and the top of the agitator is marked with the letters "H," "N" and "G" indicating High, Normal and Gentle Wash and corresponding to the drive arrangement and interconnection between finger 55 and slots 68, 67 and 66, respectively, in which the arc of the agitator is greater than, the same as, and less than the arc of the drive shaft 20.

The foregoing is a description of the presently preferred embodiment of this invention; however, variations may be made thereto without departing from the true spirit of the invention as defined by the appended claims.

What I claim is new and desire to secure by Letters Patent in the United States is:

1. In an automatic washing machine of the vertical axis type, an adjustable agitation system comprising:

input means oscillatable about a first, generally vertical, axis;

an agitator mounted for oscillation about a second, generally vertical, axis spaced from the first axis, and drive means interconnecting said agitator with said input means for oscillating said agitator about the second axis in response to oscillation of said input means about the first axis;

said drive means being manually adjustable to provide a selected one of a plurality of driving relationships between said input means and said agitator to produce oscillation of said agitator through a selected one of a plurality of oscillation arcs in response to oscillation of said input drive means through a predetermined arc.

2. An adjustable agitation system as set forth in claim 1, wherein:

said drive means includes a first drive member mounted for oscillation with said input means and a second drive member mounted for oscillation with said agitator; said first and second drive members forming a plurality of selectively engageable finger and slot arrangements extending radially of the first axis of rotation for oscillating said agitator through a selected one of a plurality of oscillation arcs in response to oscillation of said input drive means through a predetermined arc while allowing relative radial movement of the engaged finger and slot arrangement.

3. An adjustable agitation system as set forth in claim 2 wherein:

one of said drive members is adapted to be manually moved axially of said input means and agitator to disengage the previously selected finger and slot arrangement, rotated to align a subsequently selected finger and slot arrangement and moved axially of said input means and said agitator for engaging said subsequently selected finger and slot arrangement.

4. In an automatic washing machine of the vertical axis type, an adjustable agitation system comprising:

an elongated input shaft oscillatable about a first, generally vertical, axis, with a longitudinally serrated section formed on the outer surface of said shaft in the vicinity of the upper end thereof;

a hollow elongated agitator positioned over said shaft and mounted for oscillation about a second, generally vertical axis;

a first drive member having a serated bore for selective driving engagement about said serrated section of said shaft and having an elongated finger extending radially of the first axis;

a second drive member mounted to the inside of said agitator and having a bore through which said upper end of said shaft is received, said second drive member being formed with a plurality of outwardly extending slots, each of said slots extending radially of the first axis and adapted selectively to receive said finger with a radially sliding fit; whereby selective engagement of said finger in a selected one of said slots causes said agitator to oscillate through a corresponding selected arc about the second axis in response to oscillation of said drive shaft through a predetermined arc about the first axis.

5. An adjustable agitation system as set forth in claim 4, further including:

a stationary tube extending longitudinally of said shaft in coaxial relationship therewith, said tube providing support for the upper portion of said shaft;

a bearing member mounted about said tube in axially offset relationship thereto so that the longitudinal axis of said bearing is coincident with the second axis; said bearing providing support for the upper portion of said agitator.

6. An adjustable agitation system as set forth in claim 4, wherein:

said first drive member is adapted to be manually moved longitudinally of said shaft to disengage said serrated bore from said serrated section of said shaft and disengage said finger from the previous selected one of said slots, said first drive member being adapted thereupon to be manually rotated about said shaft to align said finger with a subsequently selected one of said slots and said first drive member being adapted thereupon to be moved longitudinally of said shaft to re-engage said serrated bore about said serrated section of said shaft and engage said finger in said subsequently selected one of said slots.

7. An adjustable agitation system as set forth in claim 6 further including handle means attached to said first drive member and extending through the upper end of said agitator for manual movement of said finger from one to another of said slots.

* * * * *